US009764886B2

(12) United States Patent
Bow et al.

(10) Patent No.: US 9,764,886 B2
(45) **Date of Patent: *Sep. 19, 2017**

(54) PACKAGED ORAL CARE IMPLEMENT AND METHOD OF OPENING THE SAME

(71) Applicant: COLGATE-PALMOLIVE COMPANY, New York, NY (US)

(72) Inventors: Clark Bow, Dandridge, TN (US); Alan V. Sorrentino, Cranbury, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/035,999

(22) PCT Filed: Nov. 12, 2013

(86) PCT No.: PCT/US2013/069606

§ 371 (c)(1),
(2) Date: May 11, 2016

(87) PCT Pub. No.: WO2015/072967

PCT Pub. Date: May 21, 2015

(65) Prior Publication Data

US 2016/0272400 A1 Sep. 22, 2016

(51) Int. Cl.

| | |
|---|---|
| ***B65D 75/58*** | (2006.01) |
| ***B65D 75/32*** | (2006.01) |
| ***A46B 15/00*** | (2006.01) |

(52) U.S. Cl.

CPC ..... *B65D 75/5833* (2013.01); *A46B 15/00* (2013.01); *B65D 75/326* (2013.01); *B65D 75/328* (2013.01); *B65D 2575/3227* (2013.01); *B65D 2575/3236* (2013.01); *B65D 2575/367* (2013.01)

(58) Field of Classification Search

CPC B65D 75/5833; B65D 75/326; B65D 75/328; B65D 2575/3236; B65D 2575/327; B65D 2575/3227; B65D 75/5827

USPC .... 206/368, 369, 361, 362, 362.2, 471, 461; 383/207, 200

See application file for complete search history.

(56) References Cited

U.S. PATENT DOCUMENTS

| | | | | |
|---|---|---|---|---|
| 3,689,458 A | | 9/1972 | Hellstrom | |
| 3,780,856 A | * | 12/1973 | Braverman ..... | B65D 75/327 206/459.5 |
| 3,942,640 A | | 3/1976 | Hellstrom | |
| 4,191,293 A | | 3/1980 | Newman | |

(Continued)

FOREIGN PATENT DOCUMENTS

| | | |
|---|---|---|
| CH | 619 409 | 9/1980 |
| GB | 951214 | 3/1964 |
| WO | WO 2013/025198 | 2/2013 |

OTHER PUBLICATIONS

International Search Report and the Written Opinion of the International Searching Authority issued in International Application PCT/US2013/069606 mailed Aug. 12, 2014.

*Primary Examiner* — Steven A. Reynolds

(57) ABSTRACT

A packaged oral care implement (1000) and method of opening the same. In one embodiment, the package (2000) has a first panel (100) that includes a pre-weakened line (103) including at least two portions (103A, 103B) of differing non-zero shear strengths so that an easy as open location (106) is provided.

20 Claims, 11 Drawing Sheets

(56) References Cited

U.S. PATENT DOCUMENTS 4,200,193 A * 4/1980 Boyle ..... B65D 75/366 206/461
5,033,616 A 7/1991 Wyser
5,215,381 A 6/1993 Wade
5,551,564 A 9/1996 Prater et al.
5,711,448 A 1/1998 Clarke, III
6,915,901 B2 * 7/2005 Feinberg ..... A61B 17/00491 206/363
8,042,689 B2 10/2011 Frojd et al.
2002/0162764 A1 11/2002 Sherline et al.
2004/0062493 A1 4/2004 Ishigami et al.
2004/0074917 A1 4/2004 McHutchinson
2004/0182739 A1 9/2004 Williams-Hartman
2004/0206653 A1 10/2004 Filion
2005/0145519 A1 7/2005 Fattori
2005/0167311 A1 8/2005 Tonsfeldt et al.
2005/0218027 A1 10/2005 Lammers et al.
2006/0027480 A1 2/2006 Buss
2006/0096887 A1 5/2006 Morrison
2006/0249422 A1 11/2006 Bates, Jr.
2007/0012592 A1 1/2007 Bertsch et al.
2007/0023382 A1 2/2007 Sandberg
2007/0023884 A1 2/2007 Branzell et al.
2007/0045154 A1 3/2007 Gelardi et al.
2007/0068844 A1 3/2007 Weston
2007/0102317 A1 5/2007 Crawford et al.
2007/0256307 A1 11/2007 Mann
2007/0272586 A1 11/2007 Hession
2008/0029418 A1 2/2008 Calendrille, Jr.
2008/0038046 A1 2/2008 Jalili
2008/0173564 A1 7/2008 Aldridge et al.
2008/0314791 A1 12/2008 Schweitzer et al.
2009/0090643 A1 4/2009 Fischer et al.
2009/0134054 A1 5/2009 Lee et al.
2009/0184023 A1 7/2009 Brollier et al.
2010/0018974 A1 1/2010 Lyzenga et al.
2010/0059401 A1 3/2010 Schein et al.
2010/0102062 A1 4/2010 Jones et al.
2010/0176020 A1 * 7/2010 Scarpy ..... B65D 75/22 206/469
2010/0230312 A1 * 9/2010 Sorrentino ..... B65D 21/0202 206/369
2010/0252478 A1 10/2010 Beecroft et al.
2010/0314279 A1 12/2010 Hansen et al.
2011/0042262 A1 2/2011 Naik et al.
2011/0068044 A1 3/2011 Sorrentino et al.
2011/0100845 A1 5/2011 Meech et al.
2011/0121010 A1 5/2011 Loftin et al.
2011/0174808 A1 7/2011 Prinsen et al.
2012/0048760 A1 3/2012 Karey et al.
2012/0145567 A1 * 6/2012 Nguyen ..... B65D 75/326 206/63.5
2013/0087479 A1 * 4/2013 Bloch ..... B65D 75/366 206/769
2014/0166515 A1 * 6/2014 Nguyen ..... B65D 75/367 206/368
2014/0231295 A1 * 8/2014 Ponzini ..... B65B 5/04 206/462
2014/0339111 A1 * 11/2014 Moskovich ..... B65D 75/366 206/362.3

* cited by examiner

PACKAGED ORAL CARE IMPLEMENT AND METHOD OF OPENING THE SAME

CROSS-REFERENCE TO RELATED PATENT APPLICATIONS

This application is a U.S. national stage application under 35 U.S.C. §371 of PCT Application No. PCT/US2013/069606, filed Nov. 12, 2013, the entirety of which is incorporated herein by reference.

BACKGROUND

In the commercialization of oral care implements, such as toothbrushes, the current trend is to sell said oral care implements in sealed packages. In designing such packages, the following goals are often pursued: tampering prevention; visibility of the product and marketing information; structural stability to protect the oral care implement; and ease of opening. Often, these goals are competing and, thus, must be balanced. Thus, a need exists for an improved packaged oral care implement that more adequately achieves and/or balances one or more of the aforementioned goals.

BRIEF SUMMARY

The present invention may be directed, in one aspect, to a packaged oral care implement, and method of opening the same includes a tab on one of a first panel of the package that is strategically located so that the oral care implement itself acts as a foundation adjacent to the tab that assists with shearing the first panel to release the tab for grasping, while optionally allowing the tab to be deflected in a substantially unimpeded manner into the cavity that holds the oral care implement. In another aspect, the present invention may be directed to a packaged oral care implement, and method of opening the same, that includes a first panel of the package that includes a pre-weakened lines includes at least two portions of differing non-zero shear strengths so that a targeted easy open location is provided, while at the same time preventing undetectable tampering of the interior components of the package.

In one embodiment, the invention can be a packaged oral care implement comprising: a first panel and a second panel, a cavity formed between the first and second panels; the first panel comprising at least one pre-weakened line that defines a tear-away portion and a base portion, the base portion coupled to the second panel; the base portion comprising a tab that protrudes into the tear-away portion, the tab defined by a first portion of the pre-weakened line; an oral care implement positioned within the cavity so that a portion of the oral care implement lies beneath a first portion of the tear-away portion adjacent the tab, the tab located above an unoccupied portion of the cavity; and the tab alterable, in response to a downward force applied to the tab, from: (1) a closed state in which the first portion of the pre-weakened line is intact; and (2) an open state in which the first portion of the pre-weakened line is sheared and the tab is deflected into the unoccupied portion to a depth below an upper surface of the portion of the oral care implement.

In another embodiment, the invention can be a packaged oral care implement comprising: a first panel and a second panel, a cavity formed between the first and second panels; the first panel comprising at least one pre-weakened line that defines a tear-away portion and a base portion, the base portion coupled to the second panel; the base portion comprising a tab that protrudes into the tear-away portion, the tab defined by a first portion of the pre-weakened line; and an oral care implement positioned within the cavity so that a portion of the oral care implement lies beneath a first portion of the tear-away portion adjacent the tab, the tab located above an unoccupied portion of the cavity.

In yet another embodiment, the invention can be a method of opening a packaged product comprising: providing a product disposed within a cavity of a package, the package comprising a first panel, a second panel, a cavity formed between the first and second panels, the first panel comprising at least one pre-weakened line that defines a tear-away portion and a base portion, the base portion coupled to the second panel, the base portion comprising a tab that protrudes into the tear-away portion, the tab defined by a first portion of the pre-weakened line, the product positioned within the cavity so that a portion of the product lies beneath a first portion of the tear-away portion adjacent the tab, the tab located above an unoccupied portion of the cavity; applying a downward force on the tab to cause the first portion of the tear-away portion to contact the portion of the product and shear the first portion of the pre-weakened line to release the tab, the tab deflecting into the unoccupied portion to a depth below an upper surface of the portion of the product, thereby creating an opening in the first panel; and grasping the tear-away portion via the opening and at least partially separating the tear-away portion from the base portion to provide access to the product.

In a further aspect, the invention can be a packaged oral care implement comprising: a first panel and a second panel, a cavity formed between the first and second panels; the first panel comprising at least one pre-weakened line that defines a tear-away portion and a base portion, the base portion coupled to the second panel; an oral care implement positioned within the cavity; and the pre-weakened line comprising a first portion having a first pre-weakening pattern having a first non-zero shear strength and a second portion having a second pre-weakening pattern having a second non-zero shear strength that is greater than the first non-zero shear strength.

In a yet further aspect, the invention can be a method of opening a packaged oral care implement comprising: providing an oral care implement disposed within a cavity of a package, the package comprising a first panel, a second panel, a cavity formed between the first and second panels, the first panel comprising at least one pre-weakened line that defines a tear-away portion and a base portion, the pre-weakened line comprising a first portion having a first pre-weakening pattern having a first non-zero shear strength and a second portion having a second pre-weakening pattern having a second non-zero shear strength that is greater than the first non-zero shear strength; applying a downward force at a location on the base portion adjacent the first portion of the pre-weakened line to shear the first portion of the pre-weakened line and deflect a portion of the base portion below the tear-away portion to create an opening in the first panel; and grasping the tear-away portion via the opening and at least partially separating the tear-away portion from the base portion to provide access to the oral care implement.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
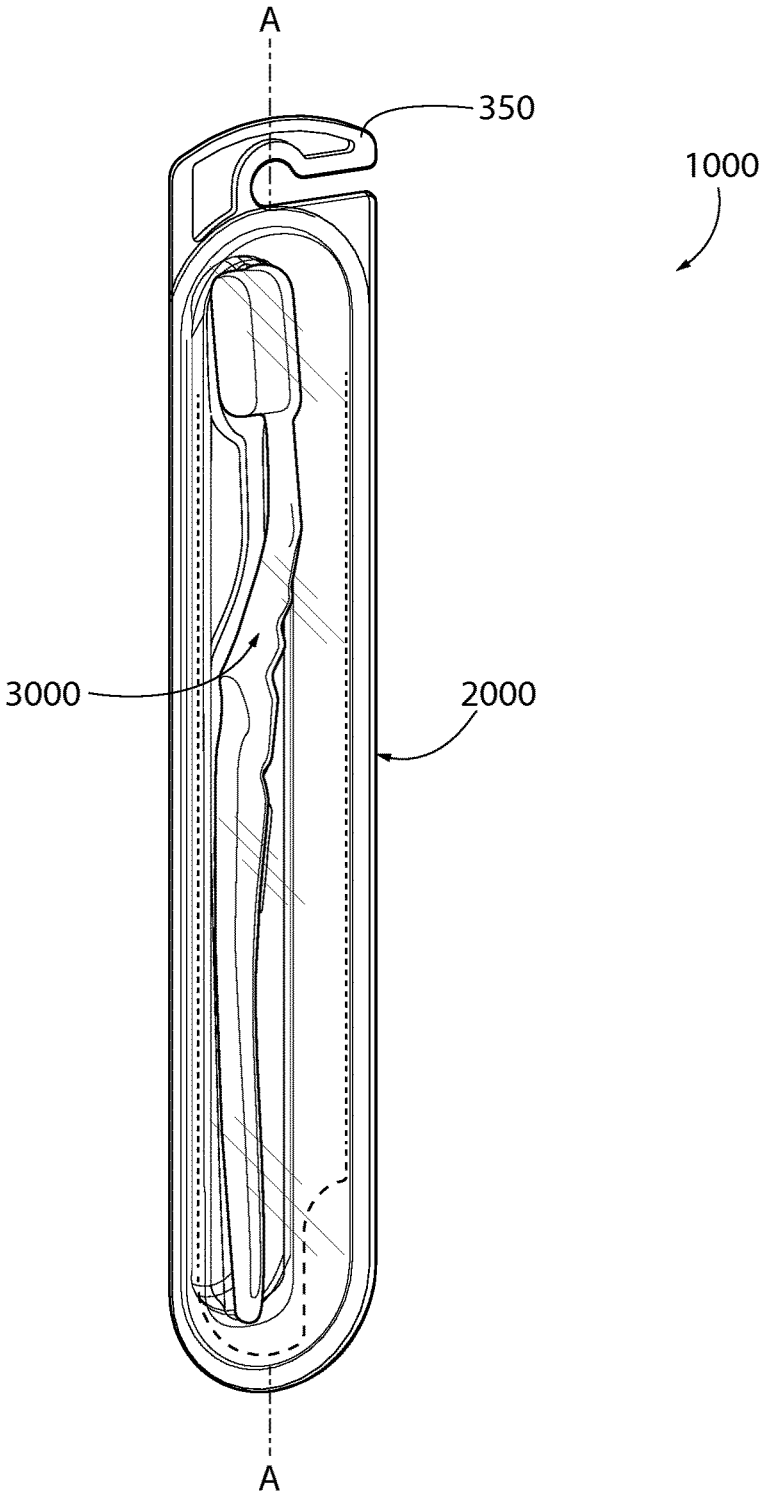
FIG. 1 is a front-perspective view of a packaged oral care implement according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
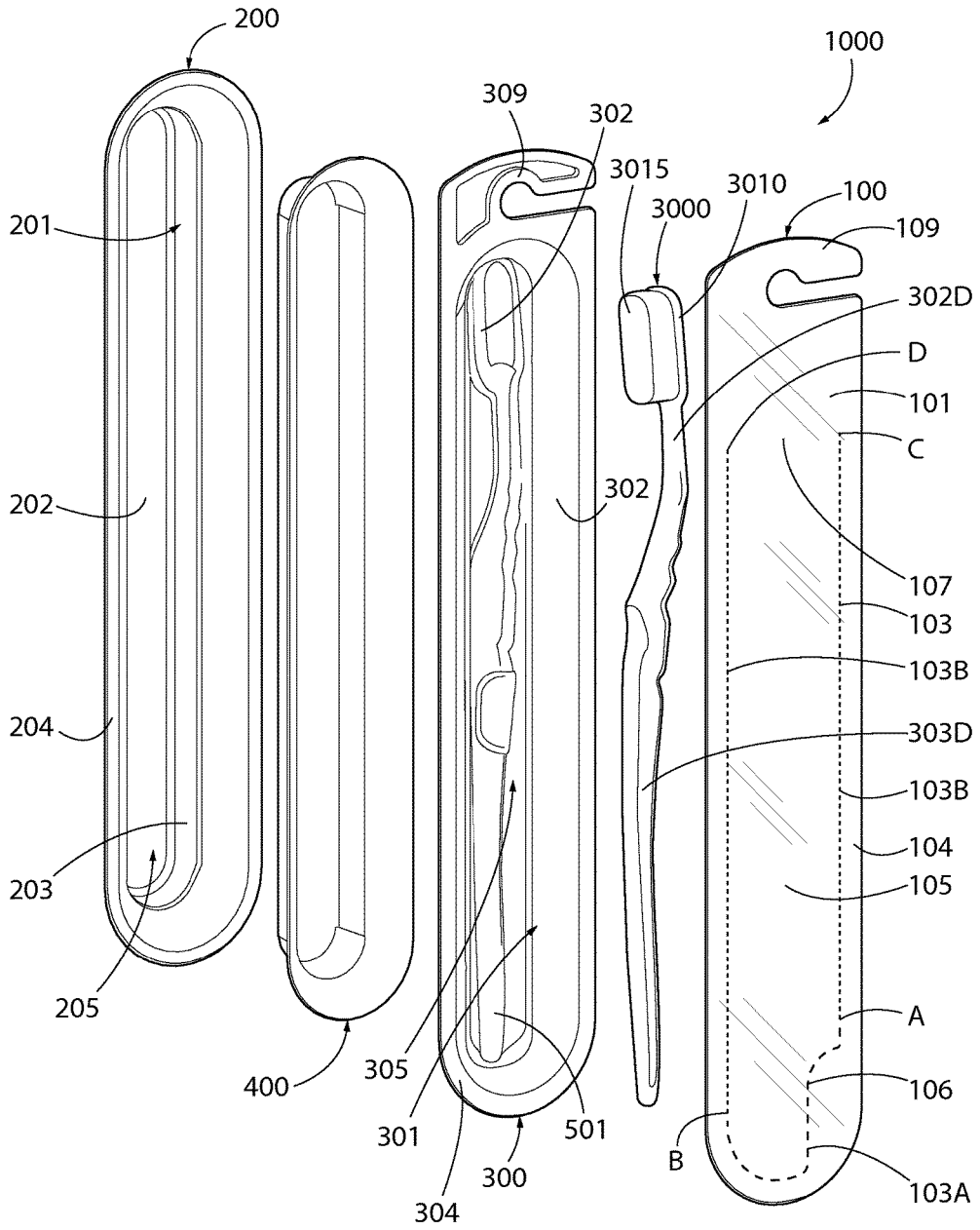
FIG. 2 is a perspective view of the packaged oral care implement of FIG. 1 in an exploded state.
Figure 4:
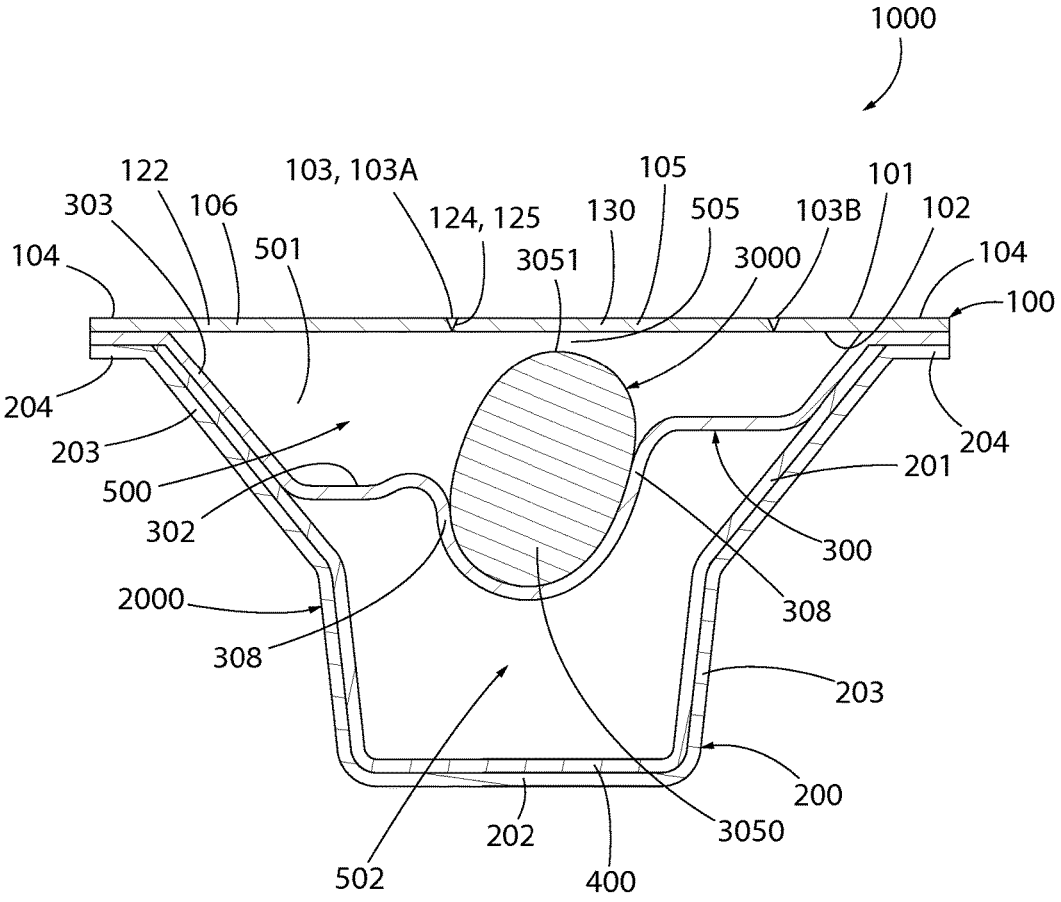
FIG. 4 is a transverse cross-sectional view of the packaged oral care implement taken along line IV-IV of FIG. 3, wherein the tab of the front panel is in a closed-state

Referring to FIGS. 1-2 and 4 concurrently, a packaged oral care implement 1000 is illustrated according to one embodiment of the present invention. The packaged oral care implement 1000 generally comprises a package 2000 and an oral care implement 3000. The oral care implement 3000, as exemplified and discussed herein, is a toothbrush 3000. In other embodiments, other oral care implements can be used in conjunction with the package 2000, including tongue cleaners, tooth polishers, oral care material dispensers, and other oral care ansate implements. Moreover, while the toothbrush 3000 is exemplified as a manual toothbrush, the toothbrush 3000 may be a powered toothbrush in other embodiments of the invention. In certain other embodiments, the invention can be the package 2000 independent of the product contained therein. In still other embodiments, the invention can be the combination of the package 2000 and another article, such as any consumer product.

The toothbrush 3000 generally comprises a head 3010, a neck 3020 and a handle 3030. The handle 3030 provides the user with a mechanism by which he/she can readily grip and manipulate the toothbrush 3000. The handle 3030 may be formed of many different shapes, sizes, materials and a variety of manufacturing methods that are well-known to those skilled in the art. If desired, the handle 3030 may include a suitable textured grip made of soft elastomeric material. The handle 3030 can be a single or multi-part construction.

The front surface of the head comprises a collection of tooth cleaning elements 3015 extending therefrom for cleaning and/or polishing contact with a user's teeth. While the collection of tooth cleaning elements 3015 is preferably suited for brushing teeth, the collection of tooth cleaning elements 3015 can also be used to polish teeth instead of or in addition to cleaning teeth. As used herein, the term "tooth cleaning elements" is used in a generic sense to refer to any structure that can be used to clean, polish or wipe the teeth through relative surface contact, or apply an oral care material thereto. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material preferably has a hardness property in the range of A8 to A25 Shore hardness. One preferred elastomeric material is styrene-ethylene/butylene-styrene block copolymer (SEBS) manufactured by GLS Corporation. Nevertheless, SEBS material from other manufacturers or other materials within and outside the noted hardness range can be used.

When the packaged oral care implement 1000 is assembled for retail display (as shown in FIG. 1), at least a portion of the toothbrush 3000 is visible from outside of the package 2000 from the front of the package 2000. The package 2000 may take on a wide variety of embodiments and may be of a wide variety of packaging types, shapes and sizes. Moreover, the package 2000 can be sized to house more than one oral care implement, such as is shown in the embodiments of FIGS. 6-9.

Referring still to FIGS. 1-2 and 4 concurrently, the package 2000 generally comprises a first panel 100, a second panel 200, a third panel 300 and a fourth panel 400. While the package 2000 is exemplified as comprising four panels 100, 200, 300, 400, the package 2000 can include additional panels in other embodiments, such as a cardboard backer panel that can include product information. In other embodiments of the package 2000, the third and/or fourth panels 300, 400 may be omitted. In one such embodiment, certain features of the third panel 300 (such as the retaining elements 308) may be incorporated into the second panel 200.

In the exemplified embodiment, the first panel 100 is the front panel of the package 2000 while the second panel 200 is the rear panel of the package 2000. As described in greater detail below, the first panel 100 is coupled to the second panel 200 to form a cavity 500 (FIG. 4) therebetween in which the toothbrush 3000 is positioned. The cavity 500 is an elongated cavity that extends along a longitudinal axis A-A, which may also be the longitudinal axis of the assembled package 2000 in certain embodiments. The third and fourth panels 300, 400 are positioned between the first and second panels 100, 200. The third panel 300 forms a floor 302 of the cavity 500 and is spaced from the second panel 200 so as to form a lower chamber 502 below the third panel 300 and between the second and third panels 200, 300. The fourth panel 400 is positioned in the lower chamber 302 adjacent the second panel 200. As exemplified, the toothbrush 3000 is positioned in the cavity 500.

Each of the first, second, third and fourth panels 100, 200, 300, 400 can be formed of a plastic and, in certain embodiments, may be formed of thermoformed plastic films. Suitable thermoformed plastic films may be constructed of such material as polyethyleneterephtalate (PETA, PETG, PETGAG), polyvinylchloride (PVC), polypropylene (PP) or styrol-butadiene-blockcopolymer (SBS). Other suitable materials of construction for the thermoformed plastic film include, without limitation, renewable primary products, for example of cornstarch, sugar (polyhydroxybutyrat/-valerat), cellulose diacetat, cellulose nitrate, polyactid (PLA), and polyhydroxybutyrat (PHB). In one embodiment, both the first and second panels 100, 200 are formed of a PVC. In another embodiment, both the first and second panels 100, 200 are formed of a PVC and the third panel 300 is formed of PETG. In either of these (and other) embodiments, the first panel 100 may be constructed of a substantially transparent PVC and the second panel 200 may be formed of a substantially opaque PVC. In some embodiments, the first panel 100 has a thickness between 3 mil to 20 mil. In one exemplary embodiment, the first panel 100 has a thickness of approximately 10 mil.

In one exemplified embodiment, the first and third panels 100, 300 are formed of a substantially transparent material, such as clarified versions of any of the materials discussed above. As used herein, the term "transparent" includes materials that allow a user to see through the material, even if the material is colored or includes a small degree of translucency. The second panel may be formed of an opaque material or may be formed of a transparent material as desired, such as any of the materials discussed above. The fourth panel 400, in certain embodiments, may be a printed graphic card that includes product information or indicia, such as instructions, graphical images, logos, advertisements, and/or other marketing information. In other embodiments, a graphic card, in addition to the fourth panel, can be included and positioned in the lower chamber 502. Such a graphic card can be formed of any of the materials described above, or other materials, such as cardboard or paper. In other embodiments, the fourth panel 400 can be replaced by such a graphic card.

The first panel 100 is a substantially flat and substantially planar panel in the exemplified embodiment. In certain other embodiments, the first panel 100 may be contoured, curved and/or include other three-dimensional topography. The first panel 100 comprises a front surface 101 and a rear surface 102. As exemplified, the bottom surface 102 of the first panel 100 is free of protuberances. This, may, however not be the certain other embodiments. The first panel 100 also comprises a pre-weakened line 103 that defines the first panel 100 into a base portion 104 and a tear-away portion 105. As will be discussed in greater detail below, the pre-weakened line 103 allows the tear-away portion 105 to be separated from the base portion 104 upon the user grasping a portion of the tear-away portion 105 and manually pulling the tear-away portion 105 away from the base portion 104.

The pre-weakened line 103, as exemplified, is formed by a series of perforations. However, in other embodiments, the pre-weakened line 103 can be formed in a wide variety of manners, including without limitation, scoring, pre-creasing, combinations thereof, and/or otherwise comprising the integrity of the first panel 100 in a controlled and targeted manner through the use of chemical energy, thermal energy, mechanical energy, or combinations thereof.

In certain embodiments, such as the illustrated one, the pre-weakened line 103 comprises at least two portions having different pre-weakening patterns that, in turn, have different non-zero shear strengths. As exemplified, the pre-weakened line 103 comprises a first portion 103A and a second portion 103B. The first portion 103A extends from a first point A to a second point B. A first section of the second portion 103B extends from the first point A to a third point C and a second section of the second portion 103B extends from the second point B to the fourth point D. Thus, in the exemplified embodiment, the first portion 103A is disposed between the first and second sections of the second portion 103B. While only one first portion 103A exists in the exemplified embodiment, more than one first portion 103A may exist. For example, in certain embodiments, the first and second portion 103, 103B may be in a continued repeating pattern.

The first portion 103A has a first pre-weakening pattern having a first non-zero shear strength. The second portion 103B has a second pre-weakening pattern having a second non-zero shear strength. The second non-zero shear strength is greater than the first non-zero shear strength. As a result, the first portion 103A of the pre-weakened line 103 is easier to shear than the second portion 103B of the pre-weakened line, thereby providing a starting position for opening the package 2000 (as discussed in greater detail below). By providing first and second portions 103A, 103B that both have non-zero shear strengths, as opposed to one of them having a zero shear strength, the package 2000 remains more adequately sealed during transport and display. Additionally, by designing the first and second portions 103A, 103B to have non-zero shear strengths (as opposed to one of them having a zero shear strength), the cavity 500 can be accessed by a person through the pre-weakened line 103 without showing visible signs of tampering. Moreover, by designing the first and second portions 103A, 103B to have non-zero shear strengths (as opposed to the same shear strength), an "easy open" section is provided while still providing other sections that have added structural integrity.

As exemplified, the first pre-weakening pattern is a first perforation pattern having slits of a first length while the second pre-weakening pattern is a second perforation pattern having slits of a second length, the second length being less than the first length. The portions/bridges between the slits are the same size in the exemplified embodiment. In other embodiments, the first and second pre-weakened patterns can take on other arrangements which will be dependent upon the type of pre-weakening line 103 used, such as a scored type, a pre-creased type, etc. In one embodiment, the first pre-weakening pattern can be a different style than that of the second pre-weakening pattern (such as perforations for the first pre-weakening pattern and scoring for the second pre-weakening pattern). While the pre-weakened line 103 is formed by first and second portions 103A, 103B that have different shear strengths in certain embodiments, in other embodiments the first and second portions 103A, 103B of the pre-weakened line 103 may have the same shear strength and/or the same the pre-weakening pattern.

In the exemplified embodiment, the first and second sections of the second portion 103B of the pre-weakened line 103 are linear in shape and extend substantially parallel to one another (and substantially parallel to the longitudinal axis A-A). The first portion 103A of the pre-weakened line 103 extends transversely, in a curvilinear form, from the first and second sections of the second portion 103B of the pre-weakened line 103 to form the distal edge of the tear-away portion 105. As will be described in greater detail below, the first portion 103A of the pre-weakened line 103 is shaped so as to define a tab 106, which is part of the base portion 104, that protrudes into the tear-away portion 105. In the exemplified embodiment, the pre-weakened line 103 is a generally U-shaped line (with the exception of the tab 106). However, the pre-weakened line 103 (and the first and second portions 103A, 103B thereof) can take on a wide variety of orientations, arrangements and shapes, thereby allowing the tear-away portion 105 to take on a wide variety of sizes, shapes and/or orientations.

Because the pre-weakened line 103 does not define a closed-geometry, the tear-away portion 105 is not free to be completely separated from the base portion 104 in the exemplified embodiment. Rather, a living hinge 107 is formed in the first panel 100 between the upper ends of the first and second sections of the second portion 103B of the pre-weakened line 103. As a result, the tear-away portion 105 is a hinged panel that pivots or bends about the living hinge 107. Thus, the tear-away portion 105 remains connected to the base portion 104 via the living hinge 107 during opening of the package 2000. In alternate embodiments of the invention, the pre-weakened line 103 may form a closed-geometry and, as such, the tear-away portion 105 may be completely separable from the base portion 104.

When the package 1000 is sealed, the entirety of the pre-weakened line 103 is intact and the base portion 104 surrounds the tear-away portion 105 of the first panel 100. The base portion 104, thus, forms a perimeter portion of the first panel 100. The base portion 104 is used to couple the first panel 100 to the second panel 200. The first panel 100 can be coupled to the second panel 200 via any suitable connection technique, including a thermal weld, an adhesive, an interference fit, a tab-lock fit, tape, staples, fasteners, or combinations thereof. The coupling between the first and second panels 100, 200 will be discussed in greater detail below.

The second panel 200 comprises a basin portion 201. The basin portion 201 comprises a floor 202 and an upstanding sidewall 203 that extends upward therefrom. The second panel 200 also comprises a flange portion 204. The flange portion 204 extends laterally outward from an upper end of the sidewall 203. As exemplified, the flange portion 204 is an annular flange. In other embodiments, the flange portion 204 may comprise flange segments that are strategically located to provide a coupling structure for the first panel 100. The basin portion 201 comprises a depression 205 that, when coupled to the first panel 100, forms the cavity 500 (and the lower chamber 502 in embodiments where the third panel 300 is included).

The third panel 300 comprises a basin portion 301. The basin portion 301 comprises a floor 302 and an upstanding sidewall 303 that extends upward therefrom. The third panel 300 also comprises a flange portion 304. The flange portion 304 extends laterally outward from an upper end of the sidewall 303. As exemplified, the flange portion 304 is an annular flange. In other embodiments, the flange portion 304 may comprise flange segments that are strategically located to provide a coupling structure for the first and second panels 100, 200. In other embodiments, the flange portion 304 may be omitted.

The floor 302 of the third panel 300 is three-dimensionally contoured to generally correspond to the general shape of the oral care implement that is to be disposed therein, which in the exemplified embodiment is the toothbrush 3000. The contoured floor 303 has floor walls 308 that act as a retaining element to maintain the toothbrush 3000 in the cavity 500 in a substantially fixed position. As will be described below, in certain embodiments, it is desirable to maintain the toothbrush 3000 in a fixed position so that it can assist in the package opening process by acting as a foundation (or barrier) that assist in the shearing of the first portion 103A of the pre-weakened line 103. While the floor walls 308 of the contoured floor 302 of the third panel 300 are the retaining element(s) in the exemplified embodiment of the package 2000, the retaining element(s) may be part of the second panel 200 and/or part of the first panel 100 in other embodiments. In still other embodiments, the retaining element(s) can be separate structures, such as blocks, struts or shims, that are positioned within the cavity 500.

The third panel 300 further comprises a hanging feature 309 at a top end thereof in the form of an open hook. The front panel 109 also has a corresponding hanging feature 110 at a top end thereof. When the package 2000 is assembled, the hanging features 309, 109 are aligned so as to form a hook 350 which may be used for hanging the packaged oral care implement 1000 for display in a retail store.

The package 2000, in one embodiment, is assembled by inserting the fourth panel 400 into the depression 205 of the basin portion 201 of the second panel 200. The third panel 300 is then positioned in the depression 205 of the basin portion 201 of the second panel 200 so that the flange portion 304 of third panel 300 rests atop the flange portion 204 of the second panel 200. The toothbrush 3000 is then positioned atop the third panel 300 and nested within the three-dimensional contouring. The front panel 100 is then positioned such that the base portion 304 of the front panel 100 abuts the flange portion 304 of the third panel 304 along the perimeter. The base portion 104 of the first panel 100, the flange portion 304 of the third panel 300, and the flange portion 204 of the second panel are then thermally fused together. Alternatively, adhesives or any of the connection techniques mentioned above may be used.

Figure 3:
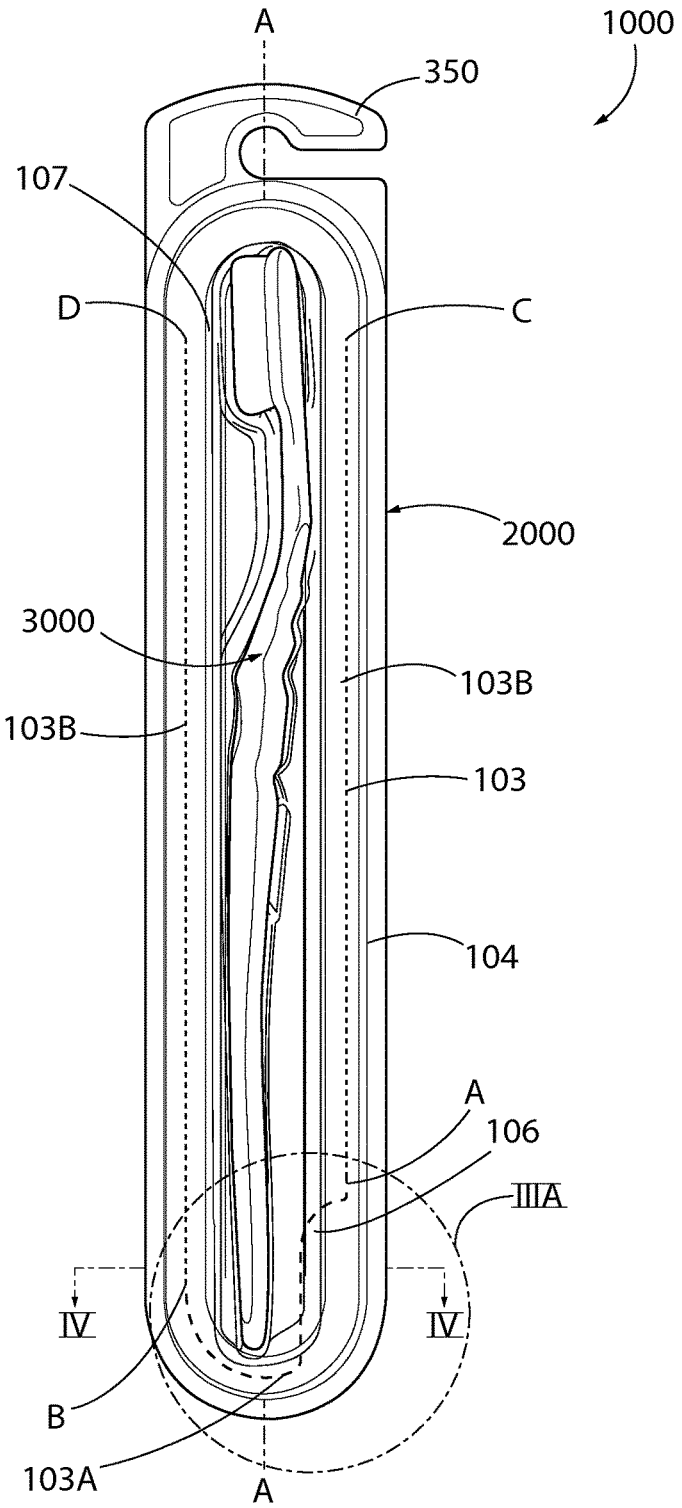
FIG. 3 is a front plan view of the packaged oral care implement of FIG. 1.
Figure 3A:
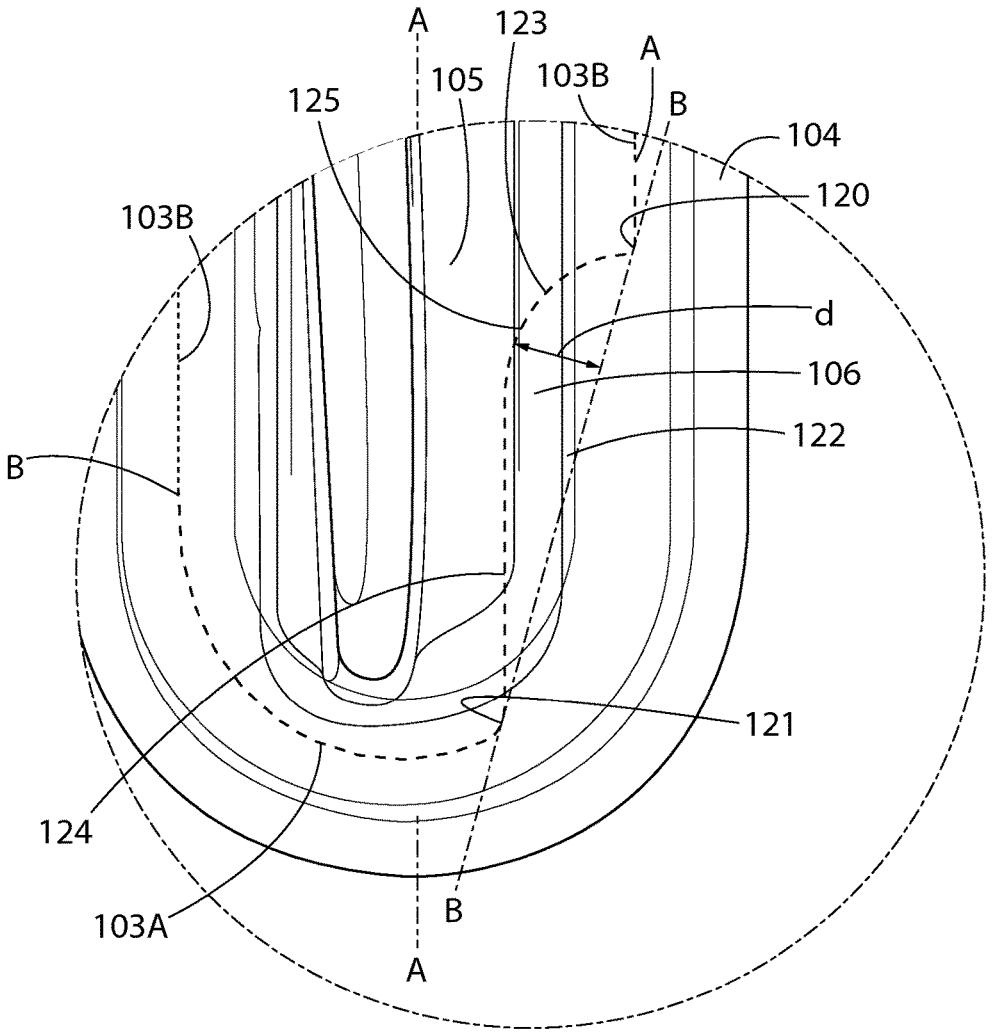
FIG. 3A is a close-up of area IIIA of FIG. 3.

Referring now to FIGS. 3 and 3A concurrently, the tab 106 of the first panel 100 will be described in greater detail according to one embodiment. The tab 106 is part of the base portion 104 of the first panel 100 and protrudes laterally inward into the tear-away portion 105. The tab 106, as exemplified, comprises a first inside corner 120 and a second inside corner 121 at a base 122 of the tab 106. The tab 106 further comprises an outside corner 123. Each of the first and second inside corners 120, 121 and the outside corner 123, in the exemplified embodiment, have a radius of curvature. The radius of curvature of each of the first and second inside corners 120, 121 is less than the radius of curvature of the outside corner 123. In other embodiments, the first and second inside corners 120, 121 and/or the outside corner 123 may be substantially rectangular.

The tab 106 comprises an edge 124 (which is a portion of the first portion 103A of the pre-weakened line 103) that extends from the first inside corner 120 to the second outside corner 121. The edge 124 comprises a distal portion 125. As discussed in greater detail below, during opening of the package 2000, a downward force F applied to the tab 106 shears the first portion 103A of the pre-weakened line 103 along the edge 124 of the tab 106. The tab 106 then deflects downward into the cavity 500. During said deflection, the tab 106 bends/flexes about a flexure axis B-B. The flexure axis B-B, in certain embodiments, extends between and intersects the first and second inside corners 120, 121. The flexure axis B-B is oriented oblique to the longitudinal axis A-A of the cavity 150 in the exemplified embodiment of FIGS. 1-5. A distal-most portion of the edge 24 is located a distance d from the flexure axis B-B.

The tab 106, in the exemplified embodiment, is located in a corner of the geometry formed by the pre-weakened line 103. In other embodiments, the tab 106 can be located at different positions along the geometry formed by the pre-weakened line 103. For example, in the embodiments exemplified in FIGS. 6 and 9, the tab 106 is located on a linear side section of the pre-weakened line 103. In this embodiment, the flexure axis B-B (see FIG. 6A) is oriented substantially parallel to the longitudinal axis A-A. In other embodiments (not illustrated), the tab 106 may be located along a bottom linear segment of the pre-weakened line 103 such that the flexure axis B-B is oriented substantially perpendicular to the longitudinal axis A-A. In certain such embodiments, the tab 106 may be defined by the first portion 103A of the pre-weakened line 103 that has the first pre-weakening pattern that has a shear strength that is less than that of the second portion 103B irrespective of location.

Figure 5:
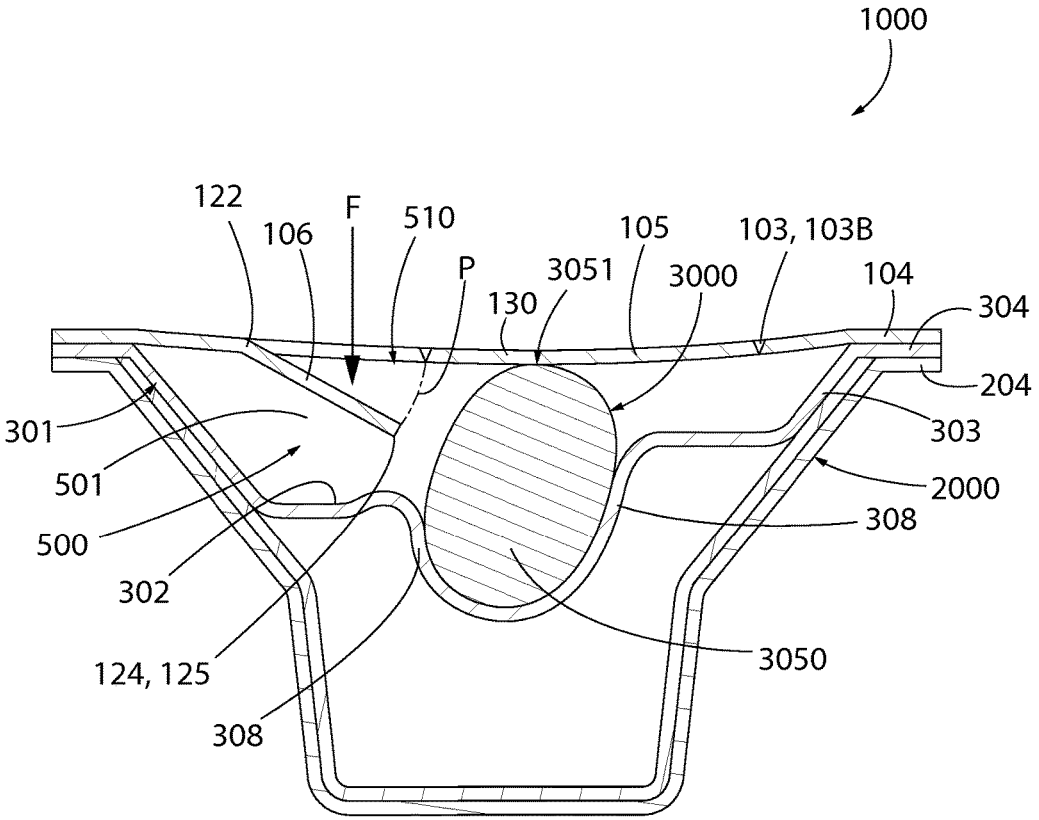
FIG. 5 is a transverse cross-sectional view of the packaged oral care implement of FIG. 4, wherein the tab of the front panel has been altered to an open-state.

Referring now to FIGS. 3-5 concurrently, the positioning of the toothbrush 3000 in the cavity 500 and the location of the tab 106, relative to one another, are strategically selected to assist in the opening of the package 2000. The toothbrush 3000 is positioned within the cavity 500 so that a portion 3050 of the toothbrush lies beneath a first portion 130 of the tear-away portion 105 of the first panel. The first portion 130 of the tear-away portion 105 of the first panel is adjacent the tab 105 of the base portion 104 of the first panel 100. The tab 106 is located above an unoccupied portion 501 of the cavity 500. The unoccupied portion 501 of the cavity 500 is empty from the floor 302 of the cavity 500 to the bottom surface 102 of the first panel 100. As can be seen in FIG. 4, in the exemplified embodiment, no portion of the oral care implement is located beneath the tab 106, as measured in a direction substantially perpendicular to a plane in which the first panel 100 is located.

When a downward force F is applied to the tab 106, the first portion 130 of the tear-away portion 105 that is adjacent the tab 106 comes into contact with the portion 3050 of the toothbrush 3000. Thus, the portion 3050 of the toothbrush 3000 acts as a foundation (or barrier) that prevents the tear-away portion 105 from continuing to flex downward with the tab 106. In certain embodiments, a small gap 505 may exist between the portion 3050 of the toothbrush 3000 and the first portion 130 of the tear-away portion 105 prior to the downward force F being applied. In other embodiments, the portion 3050 of the toothbrush 3000 may be in contact with the first portion 130 of the tear-away portion 105 prior to the downward force F being applied.

Once the first portion 130 of the tear-away portion 105 contacts the portion 3050 of the toothbrush 3000, continued application of the downward force F results in the first portion 303A of the pre-weakened line 303 to shear along the edge 124 of the tab 106, thereby releasing the edge 124 of the tab 106 from the tear-away portion 105. Thus, the tab 106 is altered from a closed state (FIG. 4) in which the first portion 303A of the pre-weakened line 303 is intact to an open state (FIG. 5) in which the first portion 303A of the pre-weakened line 303 is sheared and the tab 106 is deflected into the unoccupied portion 501 of the cavity 500. Because the cavity 500 is unoccupied beneath the tab 106, the tab 106 can be flexed into the unoccupied portion 501 of the cavity 500 to a depth below an upper surface 5031 of the portion 5030 of the toothbrush 3000. As the tab 106 is altered from the closed state to the open state, the distal portion 125 of the edge 124 of the tab 106 travels along a path P. In one embodiment, the distal portion 125 of the edge 124 of the tab 106 travels along the path P for a circumferential path of at least 30 degrees, and at least 45 degrees in other embodiments. The path P, in certain embodiments, does not intersect any portion of the toothbrush 3000. In other embodiments, the path P may intersect a portion of the TB a small amount so long as the tab 106 is sufficiently flexible such that the tab 106 can flex and ride over the portion 3050 of the toothbrush 3000.

As a result of the above, an opening 510 into the cavity 500 is formed through which the user can then slide his/her finger to grasp the tear-away portion 105. Once the user has grasped the tear-away portion 105, he/she pulls outward, thereby causing the tear-away portion 105 to be severed from the base portion 104 along the remaining intact portions of the pre-weakened line 103. As the tear-away portion 105 is severed from the base portion 104 along the pre-weakened line 103, the tear-away portion 105 is pulled out of plane with respect to the base portion 104. As a result, the package 2000 is opened and the toothbrush 200 can be removed therefrom.

While in the above example, the lower portion of the handle 3030 is the portion 3050 of the toothbrush 3000 that is used as the foundation (or barrier) that contacts the first portion 130 of the tear-away portion 105 to assist in shearing the first portion 303A of the pre-weakened line 303 to release the tab 106, other portions of the toothbrush 3000 can be utilized as the foundation (or barrier) by appropriately repositioning the toothbrush 3000 and/or the tab 106. For example, in certain embodiments, the head 3010 or the neck 3020 may be used as the portion 3050.

The tab 106, by nature of its appearance of irregularity in the geometry defined by the pre-weakened line 103, may act as a visual indicator to the user that the location of the tab 106 is the appropriate place to apply the downward force F. This is beneficial in that the first portion 303A of the pre-weakened line 303 (which has the lesser shear strength) is located adjacent the tab 106 and is, thus, the portion of the pre-weakened line 303 that will most easily shear. In some embodiments, the tab 106 may be omitted and replaced by a visual indicator that is located adjacent a portion of the pre-weakened line 303 that has the lower shear strength, such as the first portion 303A. The visual indicator may be an arrow, a graphic or alphanumeric string that would signal to the user that force should be applied in that location, which is the "easy break" portion of the pre-weakened line 303. In such an embodiment, the portion 3050 of the toothbrush 3000 can still be used as a foundation (or base) as described above to assist in the initial shearing.

Figure 6:
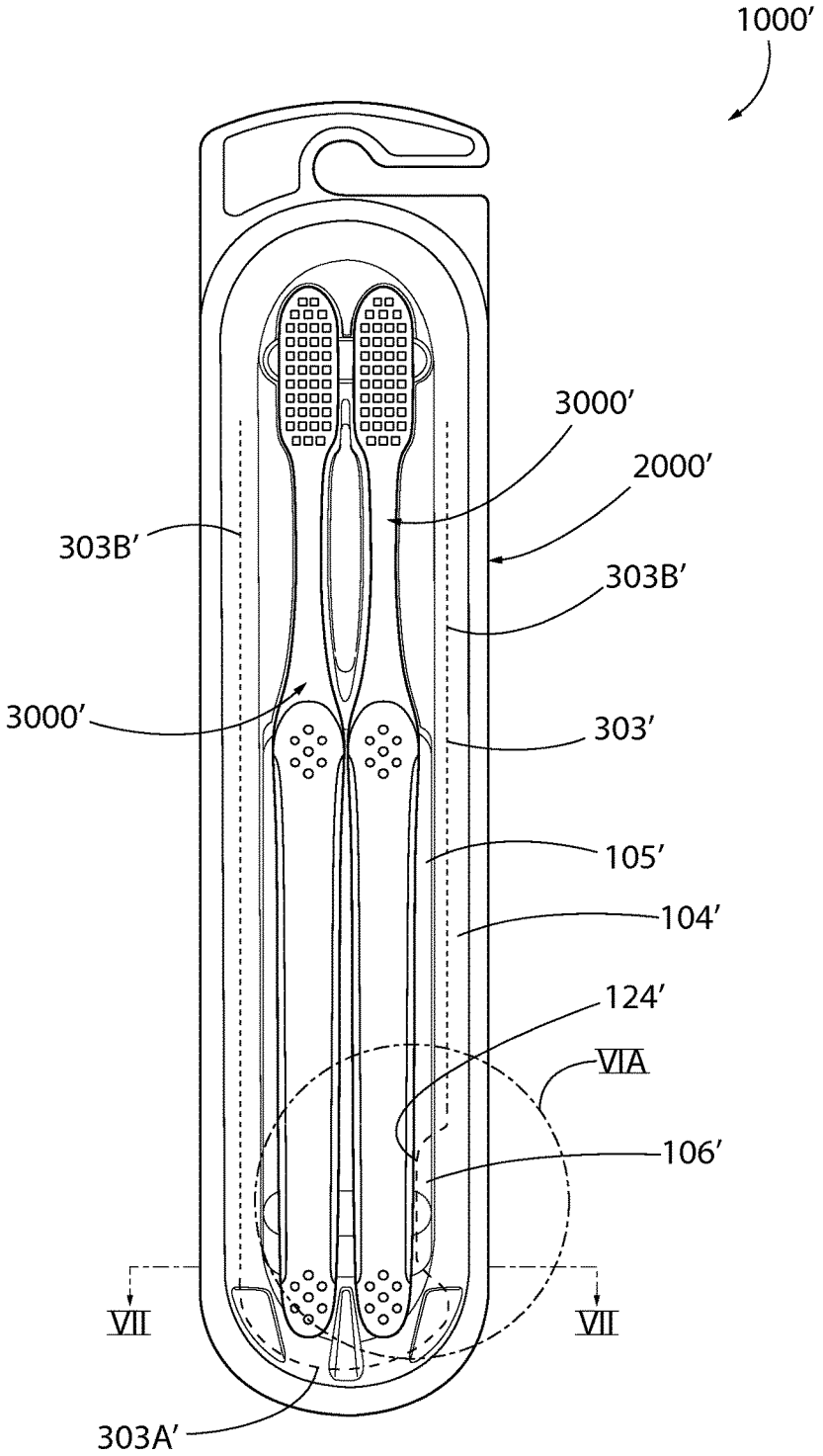
FIG. 6 is a front plan view of a packaged oral care implement according to another embodiment of the present invention.
Figure 6A:
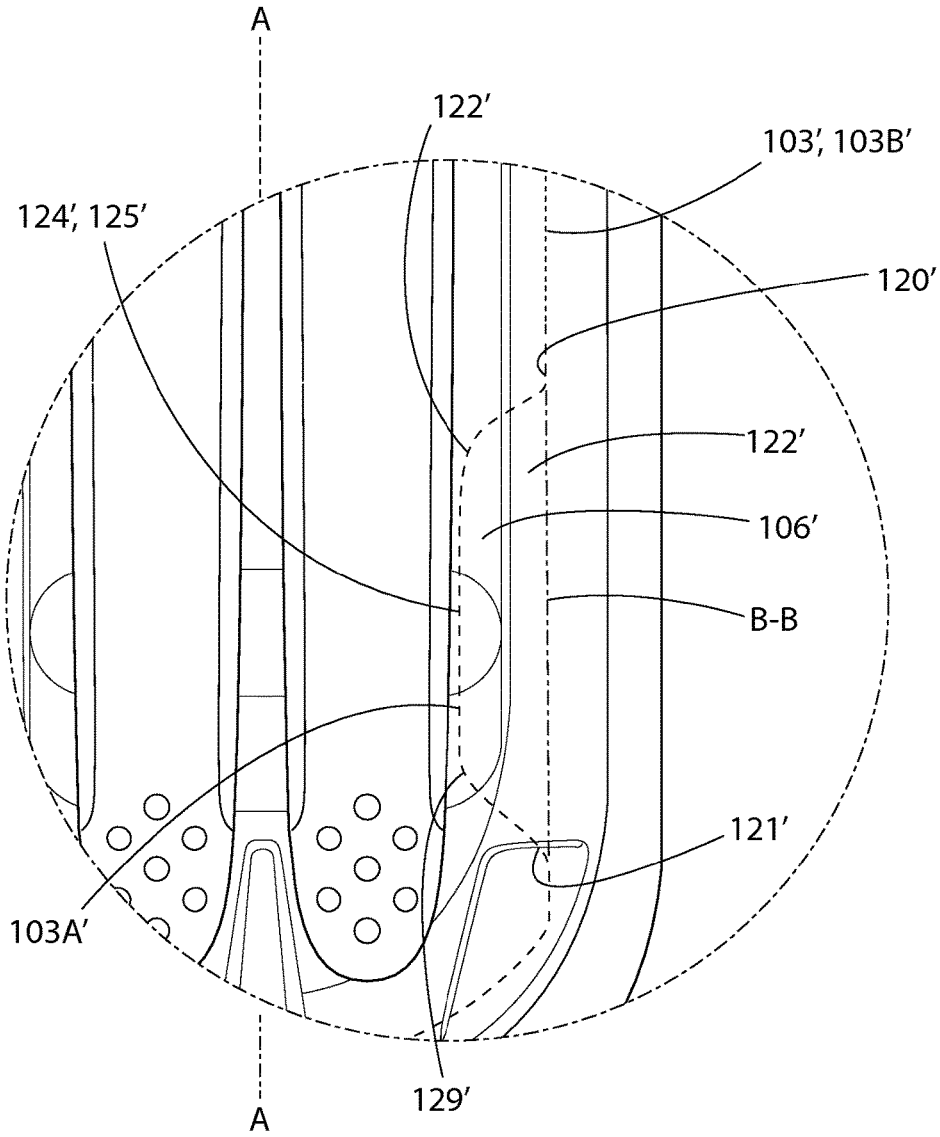
FIG. 6A is a close-up of area VIA of FIG. 6.
Figure 7:
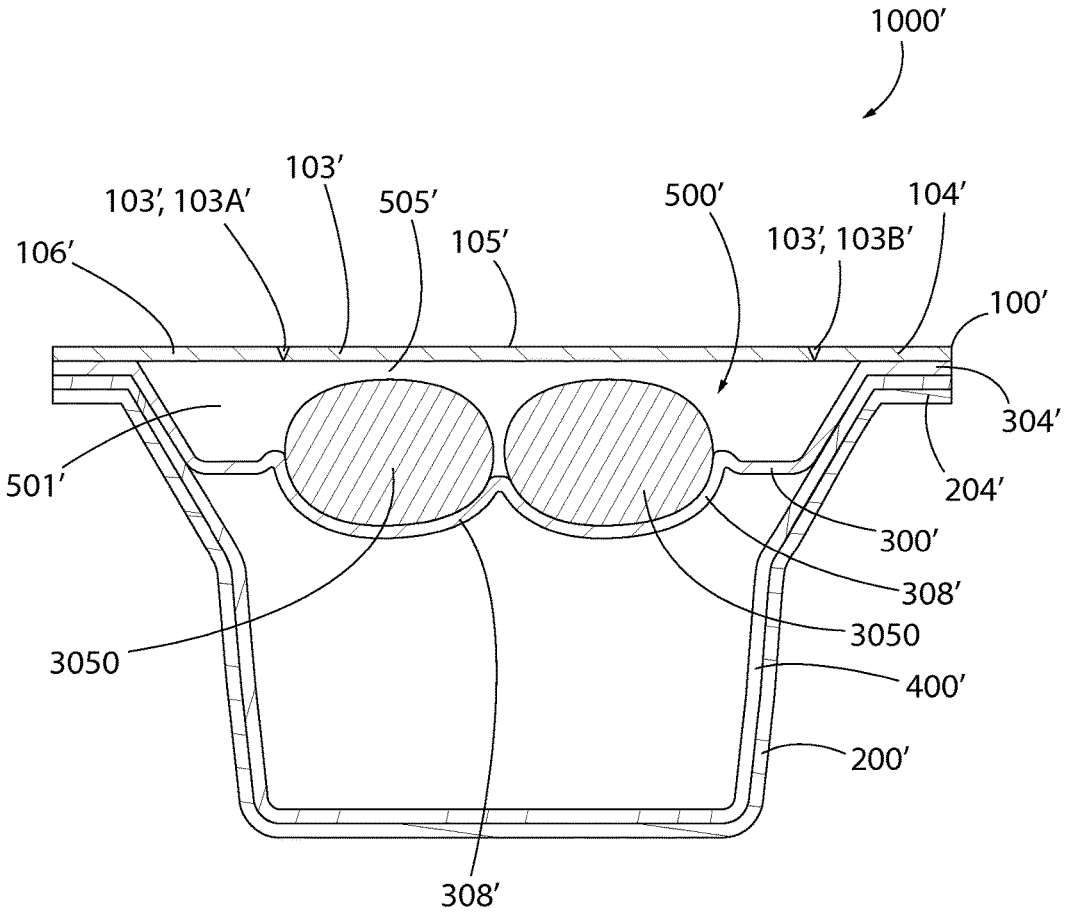
FIG. 7 is a transverse cross-sectional view of the packaged oral care implement taken along line VII-VII of FIG. 6, wherein the tab of the front panel is in a closed-state.
Figure 8:
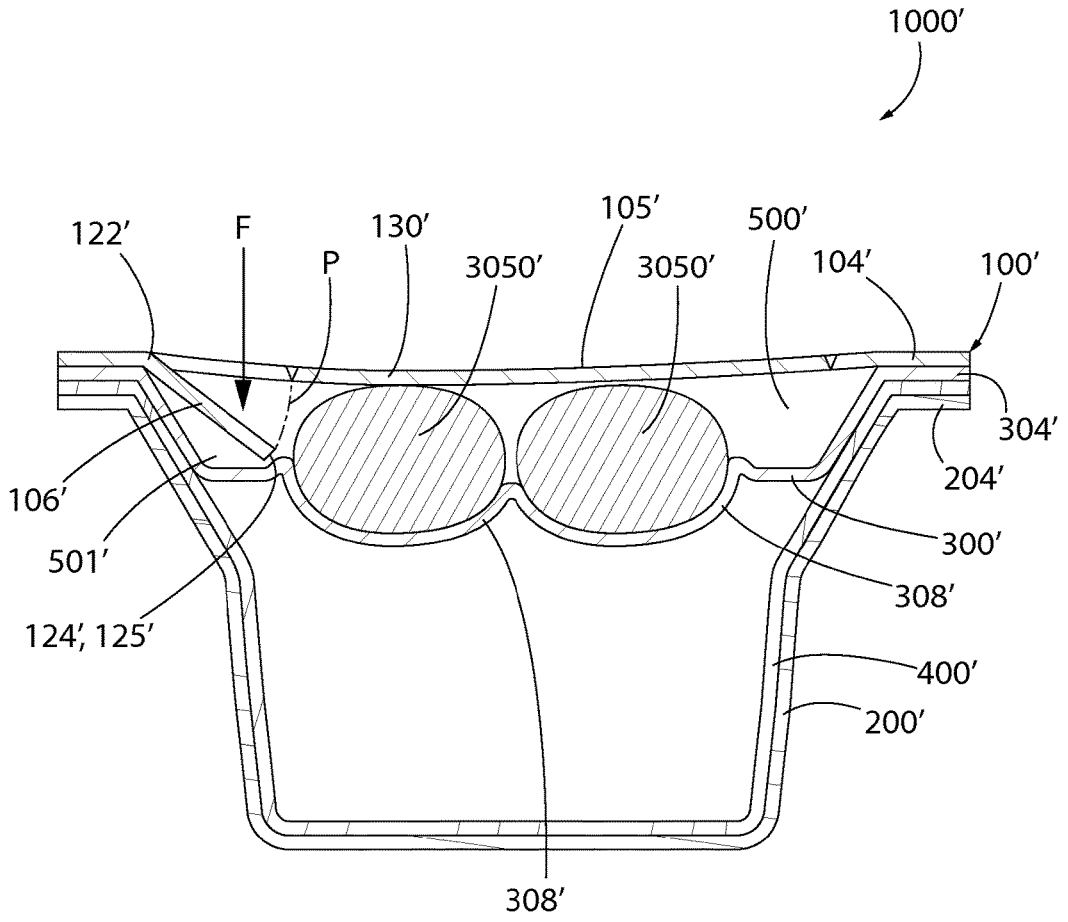
FIG. 8 is a transverse cross-sectional view of the packaged oral care implement of FIG. 7, wherein the tab of the front panel has been altered to an open-state.

Referring now to FIGS. 6-8 concurrently, a packaged oral care implement 1000' is illustrated according to another embodiment of the present invention. The packaged oral care implement 1000' is identical to the packaged oral care implement 1000 of FIGS. 1-5 with the exception that the package 2000' (and its component panels 100', 200', 300', 400') are configured to house two toothbrushes 3000' rather than one. Additionally, the tab 106' has been relocated from the corner to a linear side of the pre-weakened line 303'. Thus, in an effort to avoid redundancy, only those aspects of the packaged oral care implement 1000' that is different than the packaged oral care implement 1000 will be described below with the understanding that the description set forth above for the packaged oral care implement 1000 is applicable. Thus, like reference numbers are used to refer to like elements with the exception that a ' suffix has been added.

The tab 106' protrudes from a linear section of the pre-weakened line 103'. The tab 106', as exemplified, comprises a first inside corner 120' and a second inside corner 121' at a base 122' of the tab 106'. The tab 106' further comprises a first outside corner 123' and a second outside corner 129'. Each of the first and second inside corners 120', 121' and the first and second outside corner 123', 129', in the exemplified embodiment, have a radius of curvature. The radius of curvature of each of the first and second inside corners 120', 121' is less than the radius of curvature of the first and second outside corner 123', 129'. In other embodiments, the first and second inside corners 120, 121 and/or the first and second outside corner 123', 129' may be substantially rectangular.

The tab 106' comprises an edge 124' (which is a portion of the first portion 103A' of the pre-weakened line) that extends from the first inside corner 120' to the second outside corner 121'. The edge 124' comprises a distal portion 125'. During opening of the package 2000', a downward force F applied to the tab 106' shears the first portion 103A' of the pre-weakened line 103' along the edge 124' and the tab 106' deflects downward into the cavity 500'. During said deflection, the tab 106' bends/flexes about a flexure axis B-B. The flexure axis B-B, in certain embodiments, extends between and intersects the first and second inside corners 120', 121'. The flexure axis B-B is oriented substantially parallel to the longitudinal axis A-A of the cavity 150'. As mentioned above, the tab 106' can take on a wide variety of shapes, including without limitation triangular, rectangular, and semi-ovoid in other embodiments.

Figure 9:
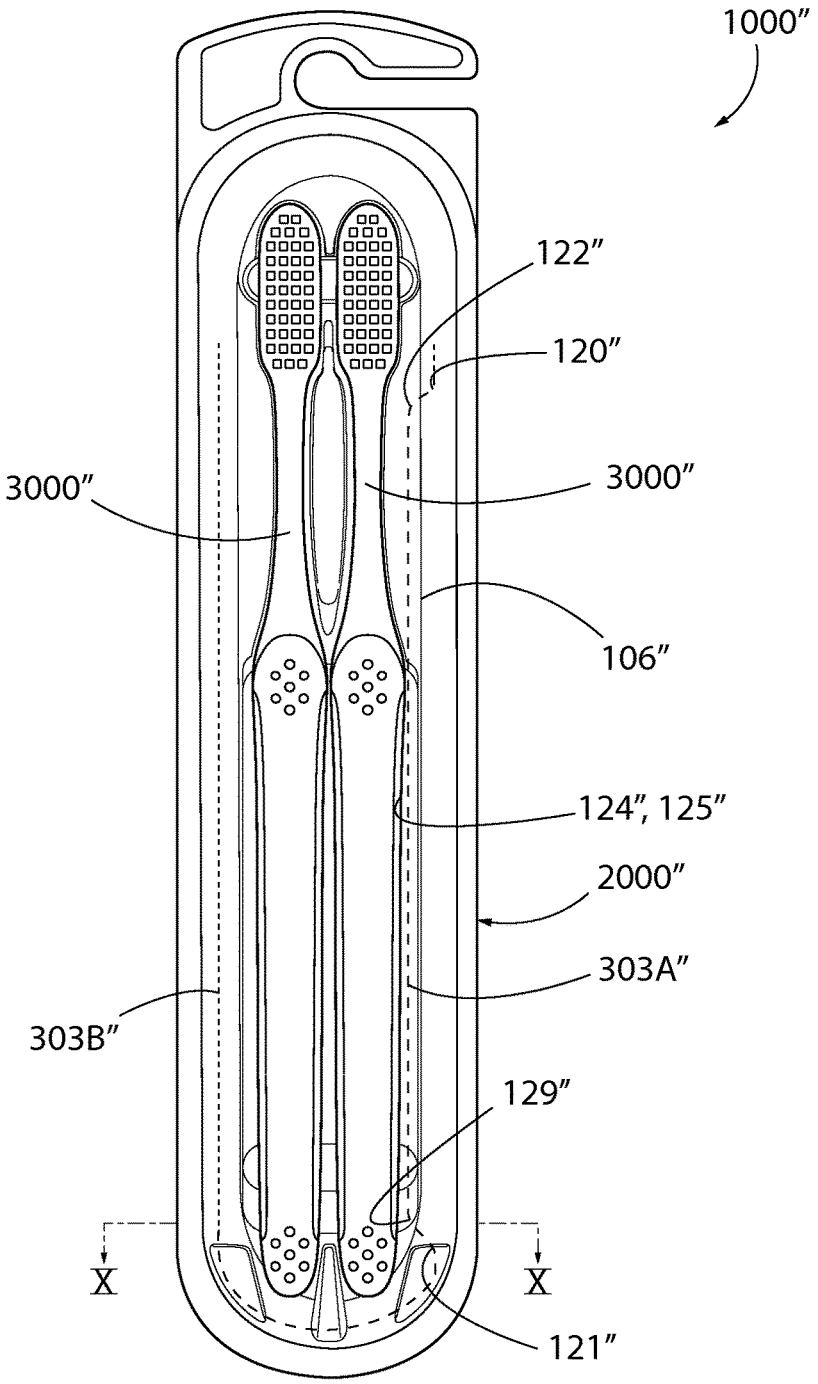
FIG. 9 is a front plan view of a packaged oral care implement according to yet another embodiment of the present invention.

Referring now to FIG. 9, a packaged oral care implement 1000" is illustrated according to a further embodiment of the present invention. The packaged oral care implement 1000" is identical to the packaged oral care implement 1000' of FIGS. 6-7 with the exception that the length of the tab 106" has been elongated. Like reference numbers are used to refer to like elements with the exception that a " suffix has been added. No further description of the packaged oral care implement 1000" is believed necessary.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A packaged oral care implement comprising:

a first panel and a second panel, a cavity formed between the first and second panels;

the first panel comprising at least one pre-weakened line that defines a tear-away portion and a base portion, the base portion coupled to the second panel;

an oral care implement positioned within the cavity; and the pre-weakened line comprising a first portion having a first pre-weakening pattern having a first non-zero shear strength and a second portion having a second pre-weakening pattern having a second non-zero shear strength that is greater than the first non-zero shear strength, wherein the base portion comprises a tab that protrudes into the tear-away portion, and wherein the oral care implement is positioned within the cavity so that a portion of the oral care implement lies beneath a first portion of the tear-away portion adjacent the tab, the tab located above an unoccupied portion of the cavity.

2. The packaged oral care implement according to claim 1 wherein an edge of the tab is defined by the first portion of the pre-weakened line.

3. The packaged oral care implement according to claim 2 wherein the cavity extends along a longitudinal axis, and wherein the tab deflects about a flexure axis that extends substantially perpendicular to the longitudinal axis.

4. The packaged oral care implement according to claim 2 wherein the cavity extends along a longitudinal axis, and wherein the tab deflects about a flexure axis that extends substantially parallel to the longitudinal axis.

5. The packaged oral care implement according to claim 2 wherein the cavity extends along a longitudinal axis, and wherein the tab deflects along a flexure axis that extends oblique to the longitudinal axis.

6. The packaged oral care implement according to claim 5 wherein the edge of the tab comprises first and second inside corners at a base of the tab and only one outside corner along a distal portion of the edge.

7. The packaged oral care implement according to claim 2 wherein the edge of the tab comprises first and second inside corners at a base of the tab and at least two outside corners along a distal portion of the edge.

8. The packaged oral care implement according to claim 2, wherein the edge of the tab comprises a distal portion, the distal portion of the edge travelling along a path when the tab is moved from the closed state to the open state, wherein the path does not intersect the oral care implement.

9. The packaged oral care implement according to claim 1 wherein the first portion of the pre-weakened line is disposed between two sections of the second portion of the pre-weakened line.

10. The packaged oral care implement according to claim 1, wherein the first panel is substantially planar.

11. The packaged oral care implement according to claim 10 wherein no portion of the oral care implement is located beneath the tab, as measured in a direction substantially perpendicular to a plane in which the first panel is located.

12. The packaged oral care implement according to claim 1 wherein the first panel is formed of a transparent PVC and the second panel is formed of an opaque PVC.

13. The packaged oral care implement according to claim 1 further comprising a retaining element that maintains the oral care implement in a substantially fixed position in the cavity.

14. The packaged oral care implement according to claim 13 further comprising a third panel, the third panel comprising the retaining element and positioned between the first and second panels so form a floor of the cavity.

15. The packaged oral care implement according to claim 14 wherein the third panel is formed of PETG.

16. The packaged oral care implement according to claim 1 the base portion forms a perimeter portion of the first panel that surrounds the tear-away portion.

17. The packaged oral care implement according to claim 1 wherein the pre-weakened line is generally U-shaped.

18. The packaged oral care implement according to claim 1 wherein the first panel comprises a visual indicator adjacent the first portion of the pre-weakened line.

19. The packaged oral care implement according to claim 18 wherein the visual indicator comprises a tab.

20. A method of opening a packaged oral care implement comprising:

providing an oral care implement disposed within a cavity of a package, the package comprising a first panel, a second panel, a cavity formed between the first and second panels, the first panel comprising at least one pre-weakened line that defines a tear-away portion and a base portion, the pre-weakened line comprising a first portion having a first pre-weakening pattern having a first non-zero shear strength and a second portion having a second pre-weakening pattern having a second non-zero shear strength that is greater than the first non-zero shear strength;

applying a downward force at a location on the base portion adjacent the first portion of the pre-weakened line to shear the first portion of the pre-weakened line and deflect a portion of the base portion below the tear-away portion to create an opening in the first panel; and grasping the tear-away portion via the opening and at least partially separating the tear-away portion from the base portion to provide access to the oral care implement, wherein the base portion comprises a tab that protrudes into the tear-away portion, and wherein the oral care implement is positioned within the cavity so that a portion of the oral care implement lies beneath a first portion of the tear-away portion adjacent the tab, the tab located above an unoccupied portion of the cavity.

* * * * *